United States Patent [19]

Washburn et al.

[11] 4,063,402

[45] Dec. 20, 1977

[54] APPARATUS FOR STUFFING THE LIMBS OF SMALL DOLLS

[75] Inventors: Dean Becker Washburn, Lawndale; Dale Paul Cleveland, El Segundo, both of Calif.

[73] Assignee: Mattel, Inc., Hawthorne, Calif.

[21] Appl. No.: 727,302

[22] Filed: Sept. 29, 1976

[51] Int. Cl.[2] ..... B65B 39/06; B65B 67/00

[52] U.S. Cl. ..... 53/258; 53/23; 53/35; 53/390

[58] Field of Search ..... 53/23, 24, 35, 123, 53/124 E, 125, 115, 255, 258, 390; 19/144.5; 141/71

[56] References Cited

U.S. PATENT DOCUMENTS

| | | | |
|---|---|---|---|
| 743,505 | 11/1903 | Heffner | 53/255 |
| 1,963,831 | 6/1934 | Coyne et al. | 53/258 |
| 1,991,379 | 2/1935 | Coyne et al. | 53/23 |
| 2,895,269 | 7/1959 | Lakso et al. | 53/115 X |
| 3,157,012 | 11/1964 | Shellman et al. | 53/115 |

*Primary Examiner*—Robert Louis Spruill
*Attorney, Agent, or Firm*—John G. Mesaros; Stephen King; Max E. Shirk

[57] ABSTRACT

An apparatus for stuffing closed-end sleeve-like cloth forms with stuffing material in the form of cord or welting, by utilizing a feed tube having one end adapted for sliding the open end of the form thereon. A push rod with a barbed end is provided for inserting the stuffing material into the feed tube and filling the form while removing it from the tube. The push rod has a handle end with a surrounding trough portion with a cylindrical configuration for telescopic engagement with the feed tube during the form stuffing operation, the trough retaining the stuffing cord for successive operations.

4 Claims, 9 Drawing Figures

2A
3
3

APPARATUS FOR STUFFING THE LIMBS OF SMALL DOLLS

BACKGROUND OF THE INVENTION

1. Field of the Invention

This invention relates generally to a method and apparatus for stuffing the limbs of small dolls and more particularly to stuffing the limbs made of a closed-end sleeve-like cloth form.

2. Description of the Prior Art

The prior art which is known to applicant is listed in a separate communication to the Patent Office, by way of illustration, and not of limitation. This exemplifies improvements over the prior art.

SUMMARY OF THE INVENTION

It is accordingly an object of this invention to provide a new and improved apparatus and method for forming small cylindrical objects.

It is another object of this invention to provide a new and improved method and apparatus for stuffing closed-end sleeve-like cloth forms to form limbs for small dolls.

The foregoing and other objects of the invention are accomplished by providing a method and apparatus for stuffing closed-end sleeve-like cloth forms with stuffing material in the form of cord or welting by utilizing a feed tube having one end adapted for sliding the open end of the form thereon. A push rod with a barbed end is utilized for inserting the stuffing material into the feed tube and filling the form while removing it from the tube. The push rod has a handle portion at one end provided with a surrounding trough portion having a cylindrical configuration for telescopic engagement with the feed tube during the form stuffing operation, the trough retaining the stuffing cord for successive operations. Sleeve means are provided for holding the components together during operation of the apparatus.

Further objects, features and advantages of the invention will become apparent when reading the specification taken in conjunction with the drawings.

DESCRIPTION OF THE PREFERRED EMBODIMENT

Figures 1, 2, 2A, 3, 4, 5:
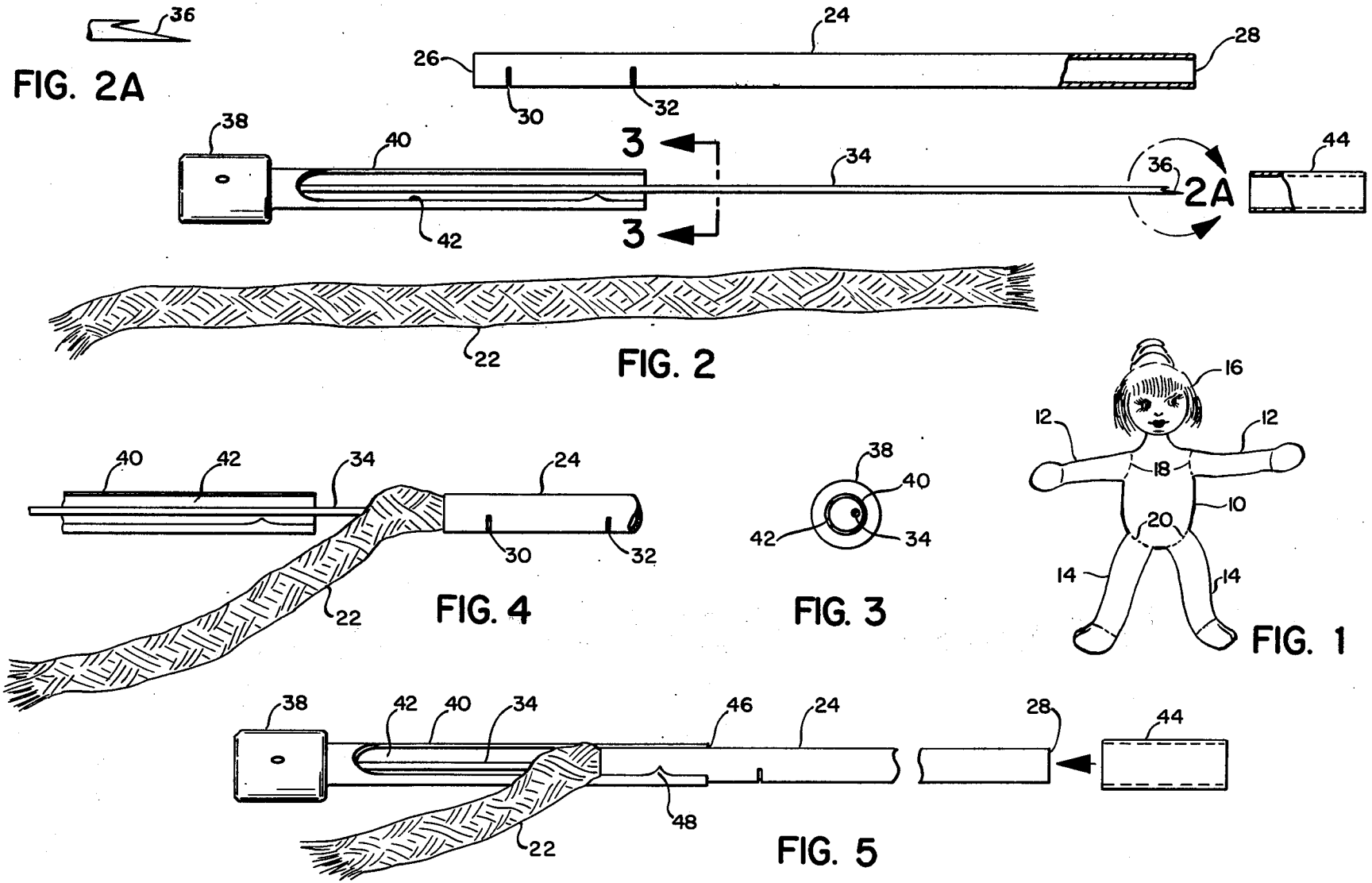
FIG. 1 is a elevational view of a small doll having cloth covered limbs.
FIG. 2 is an elevational view, partially in cross section, of the stuffing material and the parts of the stuffing apparatus in disassembled position.
FIG. 2A is an enlarged view of the barbed end of the push rod shown in FIG. 2.
FIG. 3 is a cross-sectional view of the push rod of FIG. 2 taken along line 3—3 thereof.
FIG. 4 is an elevational view partly broken away showing the position of the apparatus when inserting the stuffing cord into the feed tube by means of the push rod.
FIG. 5 is an elevational view of the parts of the stuffing apparatus in partially assembled relationship.

Referring now to the drawings and more particularly to FIG. 1 there is shown a relatively small doll having a torso 10 with arms 12 and legs 14 attached thereto, as well as a head16. The limbs and torso of the doll are cloth covered with the overall dimensions of the doll approximately 4 ½ inches in height with each of the limbs 12 and 14 being approximately ⅜ to ½ inch in diameter. In the manufacture of dolls of this type the arms 12 and the legs 14 are generally formed individually and then sewn to the torso 10 as indicated by seam lines 18 and 20.

In order to make the limbs, one method is to utilize a flat piece of cloth which is folded over with the reverse pattern side exposed. A line stitching is then applied along the long edge and one short edge to create a closed-end-sleeve-like cloth form which may ultimately be cylindrical or tapered when stuffed. The form is then turned right side out and must be stuffed with a material such as cotton or the like. If the stuffing operation is done manually without resort to aids, the time utilized in the assembly operation adds additional cost to the product in proportion to the amount of time used.

In accordance with the present invention, as shown in FIG. 2, the stuffing material 22 is in the form of a cord or welting which is usually assembled on a spool. A feed tube 24 is provided for insertion therein of the stuffing material 22 in a relatively confined manner. The feed tube 24 has both ends thereof open and has an inlet end 26 and an outlet end 28 with the inlet end being suitably scribed as shown at 30 and 32 to establish reference points for metering the proper amount of stuffing material 22 by an operator.

The stuffing material 22 can be, for example, a prefabricated cotton cord or rope which can be deformed or confined in a tube of smaller diameter than the normal diameter of the rope by applying slight force during the insertion of the stuffing material 22 into the feed tube 24. This is accomplished by means of a push rod assembly having a push rod 34 of relatively small diameter steel or the like having a length greater than the length of feed tube 24. The push rod 34 terminates in a barbed end 36, having the barbed end 36 configured unidirectionally (see FIG. 2A) that is, configured for gripping the cord 22 in one direction of travel of the push rod 34 but not in the other direction of travel. The opposite end of push rod 34 is secured to a handle 38, which has secured thereto a second tube which is generally cylindrical in cross section with a cutaway portion or opening 42 extending axially with push rod 34 to form a trough 40. As shown in FIG. 3, the push rod 34 is offset from the geometric center of the handle 38, the offset being opposite the opening 42 of the trough 40.

The internal diameter of the cylindrical trough 40 is slightly larger than the outer diameter of the feed tube 24 to permit the telescopic engagment of the trough 40 with the feed tube 24. A sleeve 44 is provided, the sleeve 44 being relatively short in overall length and double open-ended. The internal diameter of sleeve 44 is infinitesimally larger than the external diameter of cylindrical trough 40 when engaging feed tube 24, the sleeve 44 being adapted for frictionaly engaging the end of trough 40 when the components are in the assembled position.

Referring now to FIGS. 4 and 5 the stuffing material 22 is inserted into the feed tube 24 by means of the barbed end 36 of push rod 34 until as shown in FIG. 5 the trough 40 telescopingly engages feed tube 24. At this point the sleeve 44 can be attached by movement in the direction of the arrow until it engages the end 46 of trough 40, the end 46 being provided with a small triangular tab 48 to assist in the frictional engagement of sleeve 44 therewith to permit sleeve 44 to remain on the end 46 of trough 40 during the initial successive operations of the apparatus. After assembly of the apparatus the operator then successively depresses the handle 38 until the end of the stuffing material 22 is aligned with the end 28 of feed tube 24.

Figure 6:
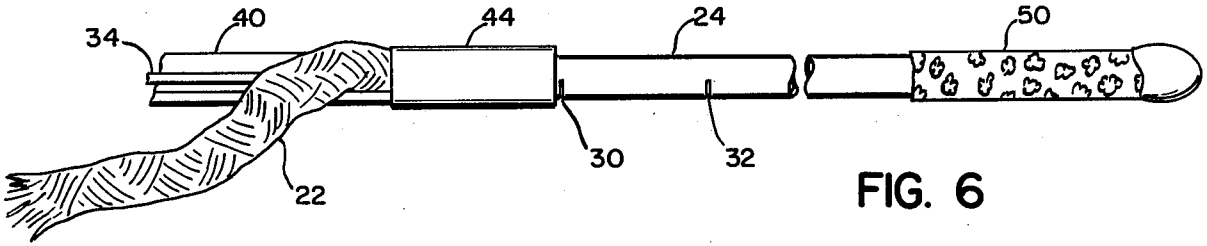
FIG. 6 is an elevational view, partially broken away of the apparatus in totally assembled position with the closed-end sleeve-like cloth form on the feed tube.

In FIG. 6 the apparatus is shown fully assembled with a closed-end sleeve-like cloth form 50 encircling and retained by the end 28 of feed tube 24, with the sleeve 44 in position about the end 46 of trough 40. In the position shown, the form 50 is prepared for the stuffing operation The operator then positions one end of sleeve 44 adjacent scribe mark 30 as shown which would indicate to the operator that the barbed end of the push rod is a given distance from the open end 28 of feed tube 24, the distance being approximately the distance between scribe marks 30 and 32.

Figure 7:
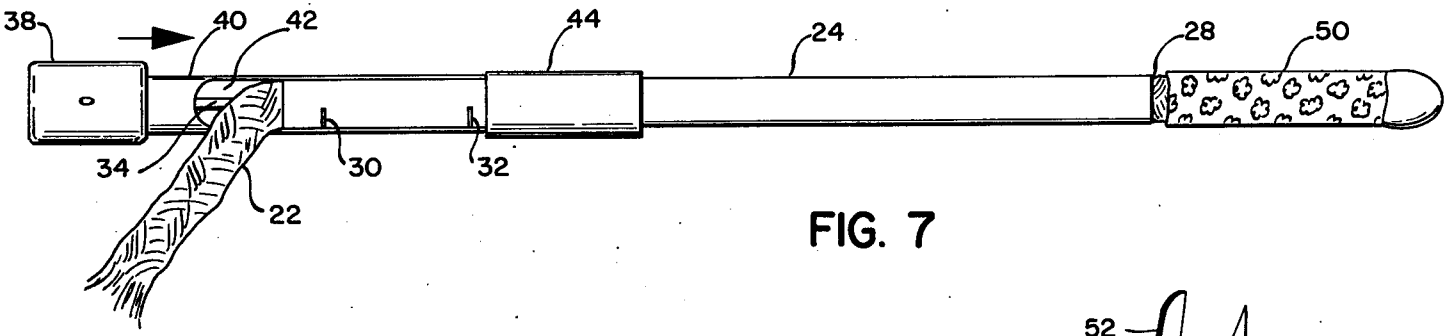
FIG. 7 is an elevational view of the stuffing apparatus with the form stuffed and removed from the end of the feed tube.
Figure 8:
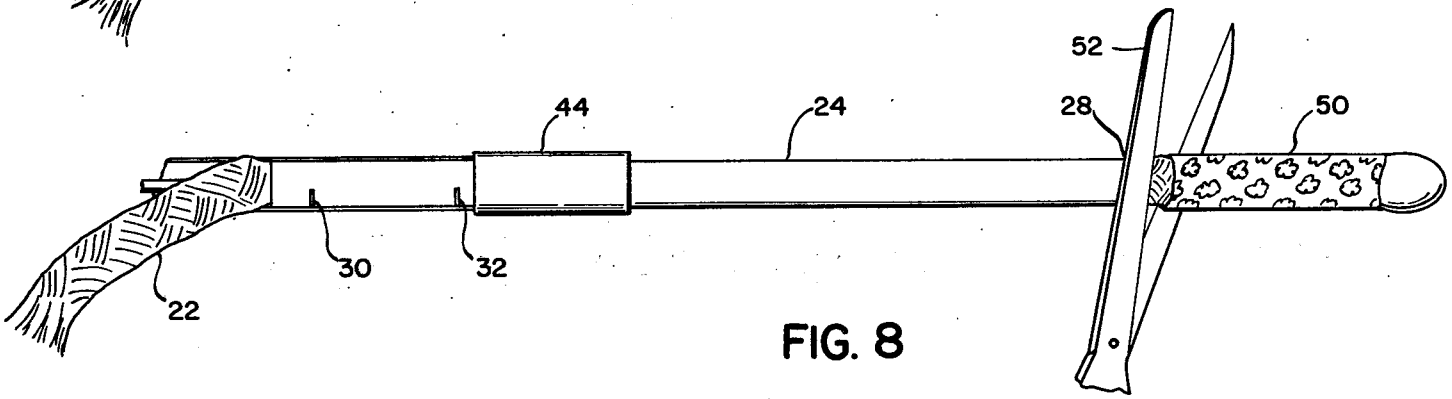
FIG. 8 is an elevational view, partially broken away, of the view of FIG. 7 to illustrate the means for removal of the stuffed form by cutting.

In the next step (FIG. 7) the handle 38 is depressed in the direction of the arrow adjacent thereto and with the other end of sleeve 44 adjacent scribe mark 32 the correct ammount of stuffing material 22 has been inserted into the form 50 with the resulting stuffed limb being removed from the end 28 of feed tube 24. The stuffing material 22 is then cut as shown in FIG. 8 by a pair of scissors 52 in proximity to the open end 28 of feed tube 24 thereby resulting in a fully completed article or limb ready to be sewn on the torso as previously discussed.

At this point the remaining stuffing material 22 is fully contained within the tube 24 with the free end of the stuffing material 22 being accessible to the tube from the remaining portion of opening 42 of trough 40 so that the cord can be successively fed in metered amounts through the tube 24 until the spool of cord or stuffing material 22 is exhausted. The operator for the next operation withdraws the handle 38 a distance determined by scribe marks 30 and 32 until the position shown in FIG. 6 is restablished. During the withdrawl of push rod 34 the barbed end 36 simply slides past the material without gripping it due to the unilaterally directional configuration of the barb 36. The operator then slides another form 50 over the end of feed tube 24 preparatory to the stuffing operation. The sequences shown in FIGS. 7 and 8 are then repeated, with each successive operation metering out a proper amount of stuffing material 22 in an efficient fashion for preparing the articles or limbs 12 and 14 for the doll.

While there has been shown and described a preferred embodiment it is to be understood that various other adaptations and modifications may be made within the spirit and scope of the invention.

What is claimed is:

1. In an apparatus for stuffing sleeve-like cloth forms with successive increments from a continuous strand of cord-like stuffing material, the combination comprising:

a first elongate tube having one end thereof configured for receiving the form over said one end;

a second tube being configured for telescopic engagement with the other end of said elongate tube, said second tube having a cutaway portion defining a trough for receiving and retaining the strand of cord-like stuffing material therein;

a push rod having a length at least equal to the length of said first tube plus the length of one of said increments of stuffing material; and means for securing one end of said push rod in an axial direction within said second tube, the free end of said push rod being provided with a unidirectional barb for engaging and inserting the cord-like stuffing material into said first tube with said first and second tubes in telescopic engagement with said barb being moved toward said one end of said first tube, said push rod stuffing and removing said form from said one end of said first tube whereby to permit successive increments of said cord-like stuffing material to be inserted into said first tube during successive manipulations of the tubes while in telescopic relationship.

2. The combination according to claim 1 furtherincluding means for retaining said second tube in telescopic relation with said first tube.

3. The combination according to claim 2 wherein said retaining means is a sleeve coacting with the open end of said second tube.

4. The combination according to claim 3 wherein said first tube is provided with indicating means thereon, said indicating means being indicative of the predetermined increment of stuffing material required for said form.

* * * * *